US008877289B2

(12) United States Patent
Yun et al.

(10) Patent No.: US 8,877,289 B2
(45) Date of Patent: Nov. 4, 2014

(54) STAINPROOFING METHOD OF FABRIC

(75) Inventors: Mi Jung Yun, Gyeonggi-do (KR); Jeong Seok Oh, Gyeonggi-do (KR); Gun Kang, Seoul (KR); Kie Youn Jeong, Gyeonggi-do (KR); Shin Hyouk Kang, Gyeongbuk (KR); Yeun Bong Park, Daegu (KR); Hyung Kook Kim, Daegu (KR); Yun Mi Kim, Daegu (KR)

(73) Assignees: Hyundai Motor Company, Seoul (KR); Kolonglotech, Inc., Gwacheon, Gyeonggi-Do (KR)

( * ) Notice: Subject to any disclaimer, the term of this patent is extended or adjusted under 35 U.S.C. 154(b) by 694 days.

(21) Appl. No.: 13/108,301

(22) Filed: May 16, 2011

(65) Prior Publication Data

US 2012/0094564 A1 Apr. 19, 2012

(30) Foreign Application Priority Data

Oct. 19, 2010 (KR) ..... 10-2010-0102124

(51) Int. Cl.

| | |
|---|---|
| ***B05D 1/18*** | (2006.01) |
| ***D06N 3/04*** | (2006.01) |
| ***D06N 3/18*** | (2006.01) |
| ***D06M 15/263*** | (2006.01) |
| ***D06M 15/277*** | (2006.01) |

(52) U.S. Cl.

CPC ..... *D06M 15/277* (2013.01); *D06N 2209/145* (2013.01); *D06N 2209/142* (2013.01); *D06N 3/047* (2013.01); *D06N 2209/067* (2013.01); *D06N 2209/147* (2013.01); *D06N 3/042* (2013.01); *D06N 2213/03* (2013.01); *D06N 3/183* (2013.01); *D06M 15/263* (2013.01)

USPC ..... 427/209; 427/314; 442/93; 442/136

(58) Field of Classification Search

CPC ..... B65G 49/00; B65G 49/02; B05D 1/18; B05D 1/20; B05D 1/36; B05D 1/38; B05D 3/00

USPC ..... 8/115.51, 115.6, 127.1, 127.6, 128.1; 427/209, 314, 372.2, 379, 430.1; 428/421, 423.1, 920, 921; 442/71, 91, 442/92, 93, 94, 95

See application file for complete search history.

(56) References Cited

U.S. PATENT DOCUMENTS 5,578,688 A 11/1996 Ito et al.
6,451,717 B1 * 9/2002 Fitzgerald et al. ..... 442/82

(Continued)

FOREIGN PATENT DOCUMENTS

JP 01118669 A 5/1989
JP 09324173 A 12/1997

(Continued)

*Primary Examiner* — Arti Singh-Pandey
(74) *Attorney, Agent, or Firm* — Edwards Wildman Palmer LLP; Peter F. Corless

(57) ABSTRACT

A method for anti-stain treatment of fabric is disclosed. The method for anti-stain treatment of fabric includes: immersing fabric in an aqueous solution containing a telomerized perfluoroalkyl acrylate copolymer, and a crosslinking agent, such as an isocyanate crosslinking agent; dehydrating the immersed fabric; drying the dehydrated fabric; heat treating the dried fabric; and coating the heat-treated fabric with a flame retardant, such as an acrylic flame retardant, to provide flame retardancy. The method provides a car seat fabric having superior stain resistance, water repellency and oil repellency without degradation of other properties required for the car seat fabric, such as flame retardancy, lightfastness, frictional coloration, or the like. The method is widely applicable to commercially applicable car seat fabrics, including flat woven, flat tricot, double raschel, or the like.

13 Claims, 1 Drawing Sheet

Telomerization

(56) References Cited

U.S. PATENT DOCUMENTS

| | | | | |
|---|---|---|---|---|
| 7,056,846 | B2 * | 6/2006 | Clark et al. | 442/94 |
| 7,078,454 | B2 * | 7/2006 | Burleigh et al. | 524/507 |
| 7,247,386 | B2 * | 7/2007 | Hooftman et al. | 428/447 |
| 7,723,452 | B2 * | 5/2010 | Hooftman et al. | 526/242 |
| 7,754,838 | B2 * | 7/2010 | Qiu | 526/248 |
| 7,871,674 | B2 * | 1/2011 | Kaplan et al. | 427/385.5 |
| 2003/0224112 | A1 * | 12/2003 | Dams | 427/372.2 |
| 2006/0021150 | A1 * | 2/2006 | Hu et al. | 8/115.51 |
| 2009/0233507 | A1 * | 9/2009 | Gross et al. | 442/82 |

FOREIGN PATENT DOCUMENTS

| | | |
|---|---|---|
| JP | 11152679 A | 6/1999 |
| KR | 89-10354 | 8/1989 |

* cited by examiner

STAINPROOFING METHOD OF FABRIC

CROSS-REFERENCE TO RELATED APPLICATIONS

This application claims priority under 35 U.S.C. §119 to Korean Patent Application No. 10-2010-0102124, filed on Oct. 19, 2010, in the Korean Intellectual Property Office, the disclosure of which is incorporated herein by reference in its entirety.

BACKGROUND (a) Technical Field

The present invention generally relates to a method for improving stain resistance and stain removal efficiency of fabric, particularly to a method for improving stain resistance and stain removal efficiency of fabric using a fluorine-based resin, preferably in combination with a crosslinking agent. More particularly, the present invention relates to a method for improving stain resistance and stain removal efficiency of fabric using a perfluoroalkyl acrylate copolymer and an isocyanate crosslinking agent.

(b) Background Art

Fabric clothes, and fabrics used in chairs, car seats and the like are often stained, for example by oils from the human body, food oils and dust in the air. Generally, products with blotted stains have a deteriorated external appearance, emit bad odors through proliferation of microorganisms, and impair product durability.

Fabric stains may be prevented by making the fabric resistant to staining or making the once-attached stain easily removable. For example, in the case of a car seat, which is difficult to wash once installed in a car, it is particularly important to make the fabric resistant to staining. Thus, vehicle manufacturers have set up their own stain standards for car seats to perform stain resistance and stain removal efficiency tests. In North America and Europe, stain removal efficiency is considered more important than stain resistance. However, in Korea, more emphasis has been put on stain resistance.

Conventionally, fluorine-based resins have been used for anti-stain processing of fiber. For example, Korean Patent No. 10-0105205 describes a method of preparing soil-resistant synthetic fiber using a perfluoroalkyl group-containing compound. However, this method requires an additional process for fiber preparation and, thus, has a disadvantage to be applied in industry. Therefore, it appears more advantageous to confer stain resistance after a fabric is prepared. In general, the anti-stain processing is carried out by covering the surface of fiber with a thin film using a fluorine-based polymer and greatly lowering surface free energy, while maintaining the rough fiber surface smooth, in order to minimize staining by oils. A method of treating fabric with an antifouling agent having a perfluoroalkyl group has been proposed, for example, in Japanese Patent Publication No. H9-324173, Korean Patent No. 10-0227100 and U.S. Pat. No. 5,578,688. However, these methods do not provide the properties required for high endurance, including stain resistance after abrasion, combustibility, frictional coloration, colorfastness, hardening, yellowing, or the like.

SUMMARY

The present invention relates to a method for simple and effective anti-stain treatment of fabric. The inventors have discovered that a fabric having superior stain resistance, water repellency and oil repellency can be obtained by a process comprising immersing a fabric in an aqueous solution, particularly an aqueous solution containing a telomerized fluorine-based resin and a crosslinking agent, dehydrating, drying, heat treating and coating with flame-retardant.

In accordance with one embodiment of the invention, the present invention provides a method for anti-stain treatment of fabric, including: immersing the fabric in an aqueous solution containing about 2-10 wt % of a telomerized perfluoroalkyl acrylate copolymer, and about 0.3-1 wt % of a crosslinking agent, preferably an isocyanate crosslinking agent; dehydrating the immersed fabric; drying the dehydrated fabric; heat treating the dried fabric; and coating the heat-treated fabric with an acrylic flame retardant.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuels derived from resources other than petroleum). As referred to herein, a hybrid vehicle is a vehicle that has two or more sources of power, for example both gasoline-powered and electric-powered vehicles.

The above and other aspects and features of the present invention will be infra.

BRIEF DESCRIPTION OF THE DRAWINGS

The above and other objects, features and advantages of the present invention will now be described in detail with reference to certain exemplary embodiments thereof illustrated in the accompanying drawings which are given hereinbelow by way of illustration only, and thus are not limitative of the invention, and wherein.

Figure 1:
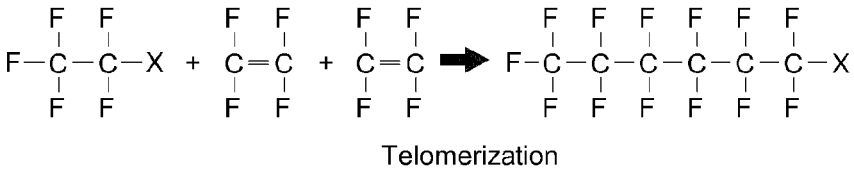
FIG. 1 schematically shows a process of preparing a fluorine-based resin by telomerization in accordance with one embodiment of the invention.
Figure 2:
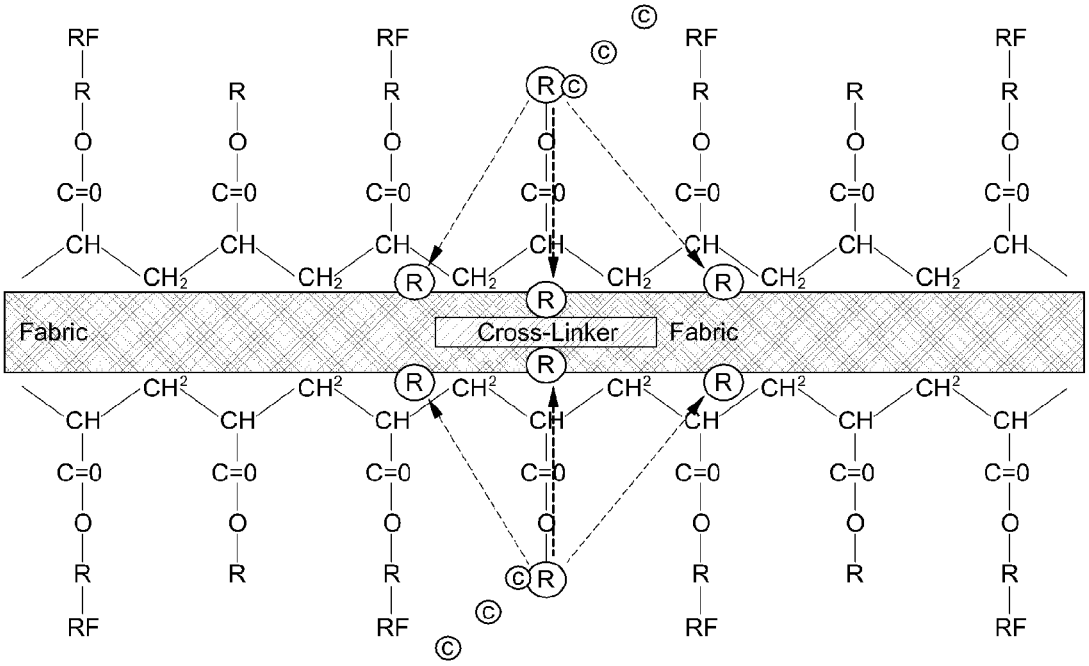
FIG. 2 schematically shows anti-stain treated fabric in accordance with one embodiment of the invention.

It should be understood that the appended drawings are not necessarily to scale, presenting a somewhat simplified representation of various preferred features illustrative of the basic principles of the invention. The specific design features of the invention as disclosed herein, including, for example, specific dimensions, orientations, locations and shapes, will be determined in part by the particular intended application and use environment.

DETAILED DESCRIPTION

Hereinafter, reference will now be made in detail to various embodiments of the present disclosure, examples of which are illustrated in the accompanying drawings and described below. While the invention will be described in conjunction with exemplary embodiments, it will be understood that the present description is not intended to limit the disclosure to those exemplary embodiments. On the contrary, the invention is intended to cover not only the exemplary embodiments, but also various alternatives, modifications, equivalents and other embodiments, which may be included within the spirit and scope of the disclosure as defined by the appended claims.

The present invention provides a method for anti-stain treatment of fabric. In particular, a method for anti-stain treatment of fabric is provided whereby an aqueous solution containing a telomerized perfluoroalkyl acrylate copolymer and an isocyanate crosslinking agent at specific proportion is used as an anti-staining agent. In certain embodiment, the crosslinking agent is an isocyanate crosslinking agent. The type of fluorine-based resin and crosslinking agent used, as well as the specific proportions of the materials in the solution are further described herein. In certain embodiments, any known flame retardant, such as an acrylic flame retardant, is coated on the anti-stain treated fabric to inhibit or prevent the decrease of flame retardancy of the fabric.

According to one embodiment, first the fabric is immersed in an aqueous solution containing a telomerized perfluoroalkyl acrylate copolymer, and a crosslinking anent, e.g., an isocyanate crosslinking agent.

The fabric may be any commercially available fabric and is not particularly limited, and is preferably a fabric for use in car seats. According to some embodiments, the fabric may be Jacquard-and-dobby-woven flat woven, flat tricot weaved using a tricot weaving machine and having flat surface and no long piles or short piles, double raschel weaved using a double raschel weaving machine and having its center cut to have piles formed on the surface, tricot suede weaved using a tricot weaving machine but having a surface with short piles feeling like artificial leather through napping or buffing, tricot cut weaved using a tricot weaving machine and having piles raised through napping and then cut uniformly through shearing, as well as circular knit, mesh, sinker pile, or the like. The fabric may be made of known fibers such as natural fiber, artificial fiber, synthetic fiber or blends thereof.

Water repellency and oil repellency of the fabric can vary greatly depending on the number of carbon atoms (i.e., chain length) and chemical structure of the fluorine-based resin. Excellent water repellency and oil repellency are attained when the fluorine-based resin adheres to the fabric tightly and uniformly. It has been found that if the fluorine-based resin has 5 to 7 carbon atoms, water repellency is attained but oil repellency may not be sufficiently achieved because the surface tension is larger than that of oils. When the fluorine-based resin has 8 or more carbon atoms, oil repellency can be attained because the surface tension becomes smaller than that of oils.

A fluorine-based resin produced by an electrochemical fluorination process has 8 carbon atoms or fewer and has a linear or branched structure. Thus, it may not adhere to the fabric tightly and uniformly and it may not easily attain desired oil repellency because the surface tension is typically larger than that of oils. On the other hand, a fluorine-based resin produced by a telomerization process may have 10 or more carbon atoms when two different monomers are used. Thus, with such fluorine-based resins, oil repellency may be attained by reducing the surface tension to be lower than that of oils. Further, the resin typically has a linear chemical structure, and thus it adheres to the fabric tightly and uniformly, giving excellent water repellency and oil repellency.

Accordingly, in accordance with the present invention, a telomerized perfluoroalkyl acrylate copolymer is preferably used as the fluorine-based resin. In some embodiments, the telomerized perfluoroalkyl acrylate copolymer solution may have a solid content of about 20-30 wt % and 10 or more carbon atoms. According to certain embodiments, the telomerized perfluoroalkyl acrylate copolymer is used in an aqueous solution state by dissolving in water. Specifically, in the case of using the telomerized perfluoroalkyl acrylate copolymer solution which has a solid content of 24 wt %, it is preferable that the aqueous solution contain about 2-10 wt % of the telomerized perfluoroalkyl acrylate copolymer. If the content of the telomerized perfluoroalkyl acrylate copolymer solution contained in the aqueous solution is too low, stain resistance may not improve sufficiently. In contrast, if it is too high, for example if it exceeds 10 wt %, the fabric may have bad touch or other properties such as reduced abrasion resistance or frictional coloration may not be good.

The crosslinking agent is used in the present solutions to confer stain removal ability. An isocyanate crosslinking agent is known to be superior to a melamine crosslinking agent in abrasion resistance and is, thus, generally preferred. However, the present crosslinking agent is not limited to isocyanate crosslinking agents and any known crosslinking agents could be suitably used. In some embodiments, the isocyanate crosslinking agent may be one or more selected from the group consisting of oxime-blocked isocyanate, toluene diisocyanate, hexamethylene diisocyanate, isophorone diisocyanate, diphenylmethane diisocyanate (methylene diphenyl diisocyanate), phenylene diisocyanate, 2-chloro-1,4-phenyl diisocyanate, naphthalene diisocyanate, xylene diisocyanate, lysine diisocyanate, tetramethylxylene diisocyanate and trimethylhexamethylene diisocyanate. According to some embodiments of the present invention, the isocyanate crosslinking agent is also used in an aqueous solution state by dissolving in water. Specifically, in the case of using the crosslinking agent solution which has a solid content of 26 wt %, it is preferable that the aqueous solution contain about 0.3-1 wt % of crosslinking agent solution. It has been found that if the content of the crosslinking agent solution is too low, a desired effect may not be attained. On the other hand, if the content is too high (e.g., if it exceeds about 1 wt %) it may result in undesirably expensive production cost.

The aqueous solution containing the fluorine-based resin (i.e., telomerized perfluoroalkyl acrylate copolymer) and the crosslinking agent (e.g., isocyanate crosslinking agent) is used as an anti-staining agent, and the fabric is immersed therein. For example, a procedure of immersing the fabric for about 5 to 10 seconds and then taking it out may be repeated 2 or more times so that the aqueous solution may uniformly penetrate the fabric.

After the immersion of the fabric, the immersed fabric is preferably dehydrated. The dehydration may be performed using any known methods, such as, for example a mangle whereby the fabric is dehydrated as it is pressed between two rollers. During the dehydration, the pressure between the two rollers may be, for example, about 3-6 kgf/cm$^2$. If the pressure between the two rollers is too low, e.g., lower than about 3 kgf/cm$^2$, drying time may increase because the fabric contains a lot of water. Further, even if high pressures are used, e.g., if the pressure exceeds about 6 kgf/cm$^2$, there is no further practical benefit in reducing water content. After the dehydration, the fabric preferably has a water content of about 40-80%.

After the dehydration, the fabric is preferably dried. The drying may be performed at suitable temperatures, such as about 120 to 140° C. In some embodiments, the drying may be performed in a tension-free state because the touch of the fabric may be not good if drying is performed under a strong tension. If the drying temperature is low, e.g., below about 120° C., process efficiency may be not good because drying time is increased. On the other hand, if the drying temperature is high, e.g., above about 140° C., it may be unfavorable in terms of frictional coloration.

The dried fabric is then preferably subjected to heat treatment at suitable temperatures. According to some embodiments, the heat treatment may be performed at about 140 to 170° C. If the heat treatment temperature is too low, the telomerized perfluoroalkyl acrylate copolymer may not be firmly attached to the fabric surface. In contrast, if the temperature is too high, the fabric may be damaged. It is further desirable that the heat treatment is performed within a constant temperature range, for example ±2° C., under a tension-free state.

The thus produced heat-treated fabric has improved stain resistance. However, flame retardancy, lightfastness, frictional coloration, electrostatic property, or the like may be degraded. Thus, in the present disclosure, a flame retardant, such as an acrylic flame retardant, can be formed on one side of the heat-treated fabric in order to provide flame retardancy.

The flame retardant (e.g., acrylic flame retardant) may be a flame retardant for coating comprising flame retardant powder, an acrylic copolymer, water and a dispersing agent. According to some embodiments, the coating may be carried out on one surface of the fabric at about 45 to 100 g/m$^2$. If the coating amount low, e.g., less than about 45 g/m$^2$, flame retardancy may be insufficient. On the other hand, if the coating amount is too large, wrinkling may occur when manufacturing a car seat or the like. The coating may be performed according to any known method, e.g., knife coating.

A post-processing of the fabric, e.g., dyeing, of the anti-stain treated fabric may lead to degraded stain resistance. Thus, it is preferable that the anti-stain treatment be performed after the post-processing.

The method for anti-stain treatment of fabric according to the present invention provides a car seat fabric with superior stain resistance, water repellency and oil repellency without degradation of other properties including flame retardancy. Such fabrics will thus satisfy stain resistance standards, such as those required by Korean automakers.

EXAMPLES

The examples and experiments will now be described. The following examples and experiments are for illustrative purposes only and not intended to limit the scope of this disclosure.

Example 1

Anti-Stain Treatment of Mesh

Polyester mesh was selected as a car seat fabric.

An aqueous solution for immersion was prepared by adding 3 wt % of a telomerized perfluoromethyl acrylate copolymer solution having 10 carbon atoms (solid content: 24%) and 0.3 wt % of an oxime-blocked isocyanate (solid content: 26%). After immersing the mesh fabric in the aqueous solution for 5 seconds, the fabric was taken out and then immersed again for 5 seconds. The immersed fabric was dehydrated to a water content of 50-70% using a mangle, at a pressure between two rollers of 4 kgf/cm$^2$. Then, after drying at 130° C. for 90 seconds, the fabric was heat-treated at 150° C. for 2 minutes. Thereafter, the fabric was anti-stain treated by knife-coating an acrylic flame retardant comprising flame retardant powder, an acrylic copolymer, water and a dispersing agent on one side of the fabric at 60-70 g/m$^2$.

Examples 2 to 5

Anti-Stain Treatment of Car Seat Fabrics

Polyester double raschel (Example 2), tricot suede (Example 3), flat woven (Example 4) and flat tricot (Example 5) fabrics were anti-stain treated in the same manner as Example 1.

Physical Property Tests

1. Stain Resistance

1) Drop Test

Water (distilled water), milk and coffee (coffee 1.8 g, cream 4.4 g, sugar 5.8 g, warm water 100 mL) were used for the tests. Each 200×200 mm sized sample (Examples 1 to 5) was placed on a flat surface and a drop of the test substance with a size of ~5 mm was dropped from a height of 30 cm using a pipette. Three drops were dropped at different positions, and the state of the drops were observed 30 seconds later. The results are given in Table 1.

2) Oil Repellency n-Tetradecane (surface tension: 26 dyne/cm) was used for the test. Each 200×200 mm sized sample (Examples 1 to 5) was placed on a flat surface and a drop of the test substance with a size of ~5 mm was dropped from a height of 30 cm using a pipette. After dropping 3 drops at different positions, the state of the drops was observed 30 seconds later. The results are given in Table 1.

3) Water Repellency

A 6:4 (w/w) mixture of water and isopropyl alcohol (surface tension 26.6 dyne/cm) was used for the tests. The test procedure was the same as the oil repellency test. The results are given in Table 1.

TABLE 1

| | Test condition | Standard requirement | Drop Test Water | Drop Test Milk | Drop Test Coffee | Oil repellency | Water repellency |
|---|---|---|---|---|---|---|---|
| Mesh | Before abrasion | A2B1 | A3 | A3 | A3 | A3 | A3 |
| | After abrasion | B3 | A3 | A3 | A3 | A3 | A3 |
| Double raschel | Before abrasion | A2B1 | A3 | A3 | A3 | A3 | A3 |
| | After abrasion | B3 | A3 | A3 | A3 | A3 | A3 |
| Tricot suede | Before abrasion | A2B1 | A3 | A3 | A3 | A3 | A3 |
| | After abrasion | B3 | A3 | A3 | A3 | A3 | A3 |
| Flat woven | Before abrasion | A2B1 | A3 | A3 | A3 | A3 | A3 |
| | After abrasion | B3 | A3 | A3 | A3 | A3 | A3 |
| Flat tricot | Before abrasion | A2B1 | A3 | A3 | A3 | A3 | A3 |
| | After abrasion | B3 | A3 | A3 | A3 | B3 | A3 |

A: distinct boundary with the drop without getting wet.
B: slightly wet on the boundary
C: clearly wet or wet by more than ⅓
D: completely wet
(For example, A2B1 means that 2 drops satisfy A and 1 drop satisfies B.)
Abrasion: The fabric surface was abraded 1,000 times using a CS-10 silicon grinding wheel under a load of 500 g, according to MS 300-32 4.11.

As seen from Table 1, the car seat fabrics that were anti-stain treated according to the present disclosure demonstrated little difference in stain resistance before and after abrasion. They also demonstrated very superior oil repellency and water repellency.

2. Flame Retardancy and Other Properties

1) Flame Retardancy

The anti-stain treated car seat fabrics of Examples 1 to 5 were cut to a width of 100 mm and a length of 350 mm. A fabric having a thickness larger than 12 mm was cut to a thickness of 12 mm. Thus prepared test samples were kept at 16-21° C. with relative humidity of 55±5% for at least 24 hours, and then in a drying furnace at 80±3° C. for 168 hours, according to KS B 9152-1978 [Combustibility test for organic automobile interior materials]. The standard requirement is presented in Table 2.

TABLE 2

| | State | | Standard requirement |
|---|---|---|---|
| Combustion rate (mm/min) (maximum) | Placed at High temperature (168 hours at 80° C.) | ≤80 | To be extinguished within 60 seconds or combustion not to burn beyond 50 mm from the measurement point |

2) Lightfastness

A 60×200 mm sample was put on 10 mm-thick soft polyurethane foam (slab foam with density 0.035±0.004) of the same size and placed in a lightfastness tester. After radiation at 84 MJ/m$^2$ (300-400 nm) and 42 MJ/m$^2$ (300-400 nm), color change was compared with the corresponding unirradiated sample. The color change was evaluated according to the gray scale [JIS L 0804, Dyeing fastness test against sunlight]. The condition in the lightfastness tester is described in Table 3.

TABLE 3

| Light source | Temperature | Humidity | Radiation intensity (Radiation at 320 nm or below is less than 1.5% of total radiation at 300-400 nm.) |
|---|---|---|---|
| Xenon | 89 ± 3° C. | 50 ± 5% RH | 60-100 W/m$^2$ (300~400 nm) |

3) Abrasion Resistance

A hole of a diameter ~6 mm was made at the center of a sample having a diameter ~150 mm. The sample was loaded in a Taber abrasion tester as specified by JIS L 1096 [Test of general fabrics]. Abrasion was carried out 1,000 times using a CS-10 grinding wheel under a load of 500 g. After the abrasion, the surface state was evaluated as described in Table 4.

TABLE 4

| Grade | Degree of abrasion |
|---|---|
| 5 | No abrasion at all. |
| 4 | Slight napping or abrasion on the surface. |
| 3 | Distinct napping on the abraded portion, or napping occurs only on the surface |
| 2 | Threads being broken at the abraded portion and heavy napping |
| 1 | severe surface abrasion enabling to see the backside |

4) Frictional Coloration a) Frictional Coloration Upon Rubbing with Dry Cloth

Two 25×220 mm samples were placed firmly in parallel on an abrasion tester (JIS L 0823 type II abrasion tester for dyeing fastness test). The samples were securely held and covered with 50×50 mm white cotton cloth. A load of 4.9 N (500 gf) was applied to the samples. Then, the samples were rubbed against the white cotton cloth 100 times, with a stroke of 100 mm and at a rate of 30 cycles/min. Then, after removing the white cotton cloth, the grade of staining was determined based on the gray scale (JIS L 0805).

b) Frictional Coloration Upon Rubbing with Sweat Cloth

Testing was carried out in the same manner as the testing with the dry cloth. White cotton cloth was immersed in an artificial sweat solution for 10 minutes and then wrung out slightly. Then, after holding the samples securely and covering with the cloth, abrasion test was conducted immediately. The artificial sweat solution was prepared by dissolving 8 g of JIS K 9019 (sodium phosphate $12H_2O$) Class 1 or better, 8 g of JIS K 8150 (sodium chloride) Class 1 or better and 5 g of JIS K 8355 (glacial acetic acid) Class 1 or better in pure water to make 1 L (pH 4.5).

The test results for combustibility and other properties are given in Table 5.

TABLE 5

| | Standard requirement | Ex. 1 (mesh) | Ex. 2 (double raschel) | Ex. 3 (tricot suede) | Ex. 4 (flat woven) | Ex. 5 (flat tricot) |
|---|---|---|---|---|---|---|
| Combustibility | ≤80 mm/min | SE | SE | SE | SE | SE |
| Lightfastness | Grade 3 or better | Grade 3 | Grade 3 | Grade 3 | Grade 3 | Grade 3 |
| Abrasion resistance | Grade 3 or better | Grade 3 | Grade 3 | Grade 3 | Grade 3 | Grade 3 |
| Frictional coloration | Grade 4 or better (dry cloth) | Grade 4 | Grade 4 | Grade 4 | Grade 4 | Grade 4 |
| | Grade 4 or better (sweat cloth) | Grade 4 | Grade 4 | Grade 4 | Grade 4 | Grade 4 |

SE: Self-extinguished

As seen from Table 5, the car seat fabrics anti-stain treated according to the present disclosure satisfied the requirements for combustibility, lightfastness, abrasion resistance and frictional coloration.

Thus, it was confirmed that, by anti-stain treating fabric with the method according to the present disclosure, a car seat fabric having superior stain resistance, water repellency and oil repellency can be obtained without degradation of other properties.

The method for anti-stain treatment of fabric according the present disclosure gives a car seat fabric having superior stain resistance, water repellency and oil repellency without degradation of other properties required for the car seat fabric, such as flame retardancy, lightfastness, frictional coloration, or the like. The method is widely applicable to commercially applicable car seat fabrics, including flat woven, flat tricot, double raschel, or the like.

The present disclosure has been described in detail with reference to specific embodiments thereof. However, it will be appreciated by those skilled in the art that various changes and modifications may be made in these embodiments without departing from the principles and spirit of the disclosure, the scope of which is defined in the appended claims and their equivalents.

What is claimed is:

1. A method for anti-stain treatment of fabric, comprising:

immersing fabric in an aqueous solution containing about 2-10 wt % of a telomerized perfluoroalkyl acrylate copolymer and about 0.3-1 wt % of an isocyanate crosslinking agent;

dehydrating the immersed fabric; drying the dehydrated fabric;

heat treating the dried fabric;

and coating the heat-treated fabric with an acrylic flame retardant coating, wherein the coating is applied at about 45-100 g/m 2.

2. The method for anti-stain treatment of fabric according to claim 1, wherein the fabric is flat woven, flat tricot, double raschel, tricot suede, tricot cut, circular knit, mesh or sinker pile.

3. The method for anti-stain treatment of fabric according to claim 1, wherein the telomerized perfluoroalkyl acrylate copolymer has 10 or more carbon atoms.

4. The method for anti-stain treatment of fabric according to claim 1, wherein the telomerized perfluoroalkyl acrylate copolymer is added to the aqueous solution in the form of a solution, based on 24% of its solid content, in the amount of about 2-10 wt % of the aqueous solution.

5. The method for anti-stain treatment of fabric according to claim 1, wherein the isocyanate crosslinking agent is added to the aqueous solution in the form of a solution, based on 26% of its solid content, in the amount of about 0.3-1 wt % of the aqueous solution.

6. The method for anti-stain treatment of fabric according to claim 1, wherein the isocyanate crosslinking agent is one or more selected from the group consisting of oxime blocked isocyanate, toluene diisocyanate, hexamethylene diisocyanate, isophorone diisocyanate, diphenylmethane diisocyanate, phenylene diisocyanate, 2-chloro-1,4-phenyl diisocyanate, naphthalene diisocyanate, xylene diisocyanate, lysine diisocyanate, tetramethylxylene diisocyanate and trimethylhexamethylene diisocyanate.

7. The method for anti-stain treatment of fabric according to claim 1, wherein the dehydration is performed using a mangle.

8. The method for anti-stain treatment of fabric according to claim 1, wherein the heat treatment is performed at about 140 to 170° C.

9. The method for anti-stain treatment of fabric according to claim 1, wherein the acrylic flame retardant is a flame retardant for coating comprising flame retardant powder, an acrylic copolymer, water and a dispersing agent.

10. The method for anti-stain treatment of fabric according to claim 1, wherein the coating is performed by knife coating.

11. An anti-stain treated fabric formed by the method according to claim 1.

12. A method for anti-stain treatment of fabric, comprising:

immersing fabric in an aqueous solution containing about 2-10 wt % of a telomerized perfluoroalkyl acrylate copolymer and about 0.3-1 wt % of a crosslinking agent;

dehydrating the immersed fabric;

drying the dehydrated fabric;

heat treating the dried fabric and coating the heat-treated fabric with a flame retardant coating.

13. The method according to claim 12, wherein the telomerized perfluoroalkyl acrylate copolymer has 8 or more carbon atoms.

* * * * *